US006152600A

United States Patent [19]

Tomic

[11] Patent Number: 6,152,600

[45] Date of Patent: Nov. 28, 2000

[54] PARTICLE-TOLERATING CLOSURE ARRANGEMENT FOR RECLOSABLE BAG AND METHODS THEREOF

[75] Inventor: Mladomir Tomic, Appleton, Wis.

[73] Assignee: Reynolds Consumer Products, Inc., Appleton, Wis.

[21] Appl. No.: 09/185,241

[22] Filed: Nov. 3, 1998

[51] Int. Cl.[7] ..... B65D 33/24

[52] U.S. Cl. ..... 383/63; 24/587

[58] Field of Search ..... 383/63, 64; 24/587

[56] References Cited

U.S. PATENT DOCUMENTS

| | | | |
|---|---|---|---|
| Re. 28,969 | 9/1976 | Naito . | |
| Re. 34,554 | 3/1994 | Ausnit | 383/63 |
| 3,347,298 | 10/1967 | Ausnit et al. . | |
| 3,416,199 | 12/1968 | Imamura | 383/63 |
| 3,827,472 | 8/1974 | Uramoto . | |
| 3,945,403 | 3/1976 | Noguchi | 383/63 |
| 3,945,872 | 3/1976 | Noguchi | 383/63 |
| 4,683,015 | 7/1987 | Wagers | 383/63 |
| 4,791,710 | 12/1988 | Nocek et al. | 24/587 |
| 4,891,309 | 1/1990 | Behymer | 24/576 |
| 5,012,561 | 5/1991 | Porchia et al. | 383/63 |
| 5,056,933 | 10/1991 | Kamp | 383/63 |
| 5,363,540 | 11/1994 | Dais et al. | 383/63 |
| 5,577,305 | 11/1996 | Johnson | 383/63 |

FOREIGN PATENT DOCUMENTS 1 063 361 8/1959 Germany .

*Primary Examiner*—Stephen P. Garbe
*Attorney, Agent, or Firm*—Merchant & Gould P.C.

[57] ABSTRACT

A method for making a reclosable bag providing a particle-tolerant closure arrangement preventing the interference with the closure arrangement by small particles and granular-type products. The female profile includes first and second legs deflectable between a mated position when engaged with a male profile and an unmated position when not engaged with the male profile. Each of the first and second legs include an attachment end and an engagement end, and the first and second legs have opposing sections that are separated by a distance in the unmated position based upon a grain size of the granular product to be stored in the bag. The male profile includes a stem having a head and a base at opposite ends thereof, and is arranged to interlock with the first and second legs. The method includes attaching the attachment end of the first and second legs to the film, and attaching the base of the stem to the film. A zipper for a reclosable bag, and a reclosable bag are also disclosed.

7 Claims, 6 Drawing Sheets

PARTICLE-TOLERATING CLOSURE ARRANGEMENT FOR RECLOSABLE BAG AND METHODS THEREOF

FIELD OF THE INVENTION

The present invention relates to a closure arrangement for a reclosable bag. More particularly, the invention relates to a zipper having male and female profiles.

BACKGROUND OF THE INVENTION

Many consumer packaging applications employ reclosable bags. Reclosable bags sometimes use a mating reclosure device for sealing products within the bags. For example, one zipper-type of reclosure device includes male and female profiles extending along the entire length of the zipper. The male profile typically may be tree-shaped, with an expanded head portion supported by a narrower trunk portion. The mating female profile is disposed opposite to the male profile and is adapted to mate with the male profile by a pair of legs having locking edges or cornered shoulders. The profiles are interlocked by properly aligning the male and female profiles and pressing them together along the entire length of the zipper. The opposing legs of the female profile slide over the expanded head portion of the male, and lock to it by hooking the head with the cornered shoulders and resting in the trunk portion.

If the reclosable bag is holding a granular, dusty, or particulate material, the reclosure device can be problematic. Particles of the grain or dust get caught between the female legs. When this happens, the mating profiles are often precluded from interlocking because of the presence of the particles. As a result, the bag may not be completely sealed.

SUMMARY OF THE INVENTION

One aspect of the present invention is directed to a method for making a reclosable bag. The method comprises providing a continuous polymeric film, and providing female and male profiles. The female profile includes first and second legs deflectable between a mated position when engaged with a male profile and an unmated position when not engaged with the male profile. Each of the first and second legs include an attachment end and an engagement end, and the first and second legs have opposing sections that are separated by a distance in the unmated position based upon a grain size of the granular product to be stored in the bag. The male profile includes a stem having a head and a base at opposite ends thereof, and is arranged to interlock with the first and second legs. The method includes attaching the attachment end of the first and second legs to the film, and attaching the base of the stem to the film.

In certain implementations, the step of providing a female profile includes extruding the profile including the first and second legs, with the distance between the first and second legs in the unmated position being no greater than about 0.007 inch.

In some applications, the step of providing a female profile includes extruding the first and second legs to each have a flat surface arranged to contact the male profile. Other engagement ends of the first and second legs include a rounded surface arranged to contact the male profile.

In certain implementations, providing the male profile includes extruding the stem to a include a base having a first width across the stem no wider than any other width across the stem.

In some applications, providing the male profile includes extruding the stem to include a region having a second width less than the first width. The male profile includes extruding the stem to include first and second notches on opposite sides of the stem. Other male profiles include extruding the stem to include a plurality of bumps and troughs on opposite sides of the stem. Yet other male profiles include extruding the stem to include a plurality of barbs on opposite sides of the stem.

In certain embodiments, attaching the attachment end of the first and second legs to the film includes heat sealing the attachment end to the film; and attaching the base of the stem to the film includes heat sealing the base of the stem to the film.

In some implementations, the method also includes folding the film to form first and second opposed panel sections; and heat sealing the first and second panel sections along two edges to create an enclosed region for holding a granular product.

In another aspect, the present invention is directed to a zipper for use in a reclosable bag. The zipper comprises a female profile and male profile. The female profile, adapted for attachment to a first panel section of the bag, includes first and second legs deflectable between a mated position when engaged with a male profile and an unmated position when not engaged with the male profile. The first and second legs have opposing sections that are separated by a distance no greater than about 0.007 inch when in the unmated position. A male profile includes a stem having a head and a base at opposite ends thereof. The base is adapted for attachment to a second panel section of the bag, and the stem is arranged to interlock with the first and second legs.

In certain implementations, the first and second legs touch when in the unmated position.

In certain embodiments, the base of the male profile has a first width across the stem, and the first width is at least as wide as any other width across the stem.

In some applications, the first and second legs each include an attachment end arranged to attach to the first panel section and an engagement end arranged to engage the male profile. Some of the engagement ends of the first and second legs include a flat surface for contacting the male profile. Other engagement ends of the first and second legs include a rounded surface arranged to contact the male profile.

Some stem implementations include the stem having a region with a second width less than the first width. In one application, the region includes first and second notches on opposite sides of the stem. In one application, the second notch is deeper than the first notch. In certain applications, the first notch is angled with respect to the stem no more than about 90 degrees, and the second notch is angled with respect to the stem greater than about 90 degrees.

In one application, the region includes a first plurality of bumps and troughs on a first side of the stem, and a second plurality of bumps and troughs on a second side of the stem opposite to the first side of the stem. In another application, the region includes a first plurality of barbs on a first side of the stem, and a second plurality of barbs on a second side of the stem opposite to the first side of the stem.

In certain implementations, the head of the stem is tapered inwardly. In other applications, the head of the stem is rounded.

The present invention also is directed to a reclosable bag. The bag includes first and second opposing panel sections, a female profile, and a male profile. The female profile is attached to the first panel section of the bag and includes first and second opposing legs. The male profile includes a stem having a head and a base at opposite ends thereof. The base has a first width across the stem and is attached to a second panel section of the bag. The stem is arranged to interlock with the first and second legs, and the first width is at least as wide as any other width across the stem.

The first and second legs each include an attachment end arranged to attach to the first panel section, and an engagement end arranged to engage the male profile. In some applications, each of the engagement ends of the first and second legs include a flat surface arranged to contact the male profile. In other applications, each of the engagement ends of the first and second legs include a rounded surface arranged to contact the male profile.

In some implementations, the stem includes a region having a second width less than the first width. The region, in certain applications, includes first and second notches on opposite sides of the stem. In certain implementations, the region includes a first plurality of bumps and troughs on a first side of the stem, and a second plurality of bumps and troughs on a second side of the stem opposite to the first side of the stem. In other implementations, the region includes a first plurality of barbs on a first side of the stem, and a second plurality of barbs on a second side of the stem opposite to the first side of the stem.

In some embodiments, the first and second legs are deflectable between a mated position when engaged with the male profile and an unmated position when not engaged with the male profile, the first and second legs being no greater than about 0.005 inch apart when in the unmated position. The first and second legs, in certain applications, are touching when in the unmated position.

The above summary of the present invention is not intended to describe each illustrated embodiment, or every implementation, of the present invention. This is the purpose of the figures and the detailed description which follow.

BRIEF DESCRIPTION OF THE DRAWINGS

Other aspects and advantages of the invention will become apparent upon reading the following detailed description and upon reference to the drawings in which.

Figure 1:
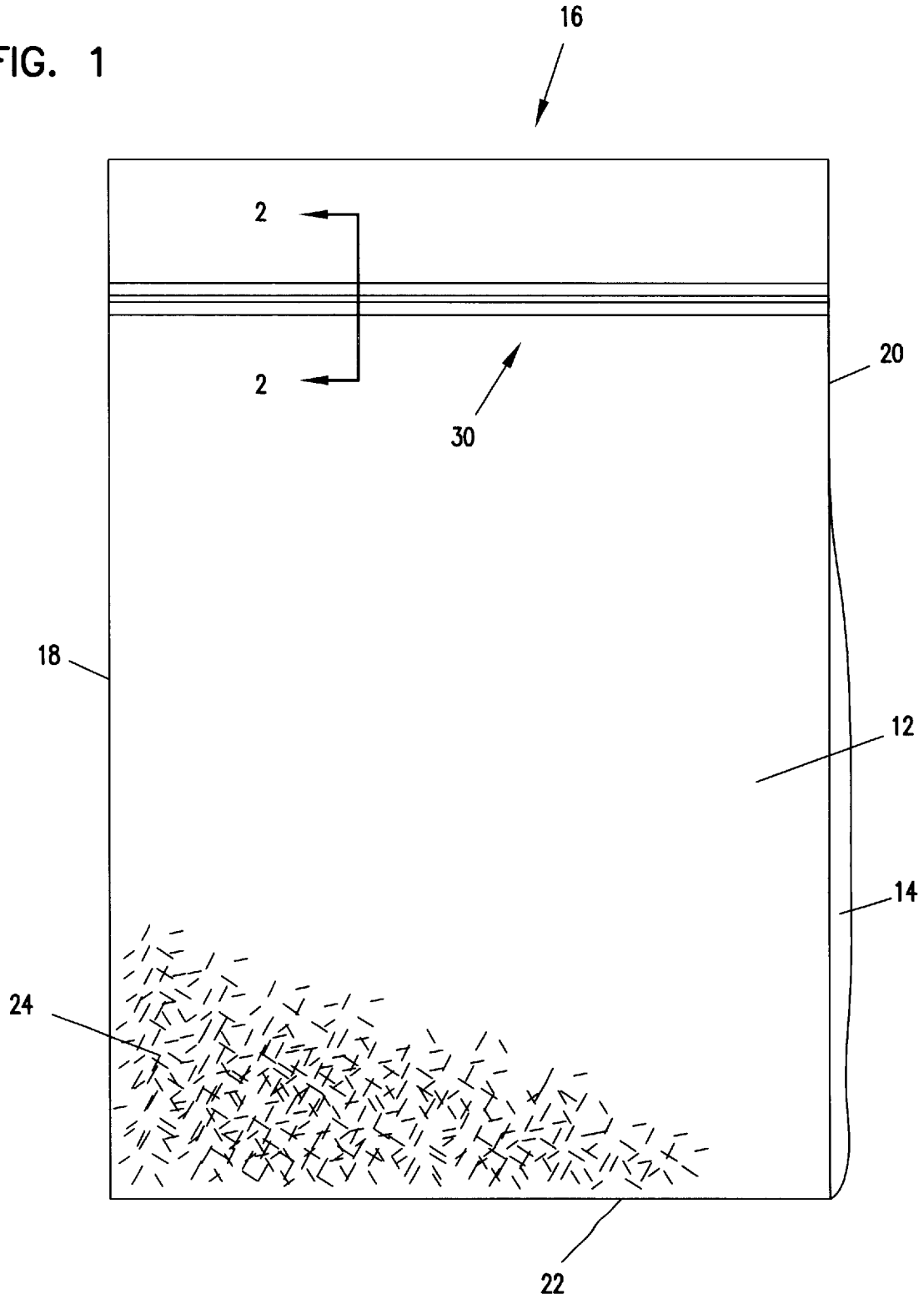
FIG. 1 is a perspective view of a reclosable bag, in accordance with the present invention.

While the invention is susceptible to various modifications and alternative forms, specifics thereof have been shown by way of example in the drawings and will be described in detail. It should be understood, however, that the intention is not to limit the invention to the particular embodiment described. On the contrary, the intention is to cover all modifications, equivalents, and alternatives falling within the spirit and scope of the invention as defined by the appended claims.

DESCRIPTION OF THE VARIOUS EMBODIMENTS

The present invention is directed to reclosable flexible packaging arrangements and has been found to be particularly beneficial for use in connection with reclosable packages, for example, plastic bags including interlocking closure devices. Using a closure device that has a zipper-type interlocking structure as a specific example, grainy or powdered materials stored in the bag may get stuck within the zipper and preclude its closure. While the present invention is not necessarily limited to this type of reclosable package, the present invention has particular application to such structural environments which are susceptible to this type of problem.

Turning now to the drawings, FIG. 1 illustrates an exemplary packaging arrangement, constructed in accordance with the present invention, in the form of a reclosable flexible bag 10 having a zipper-type reclosure structure. Flexible bag 10 is made of first and second opposed panel sections 12, 14 of a polymeric film. For many manufacturing applications, first and second panel sections 12, 14 are heat sealed together along two side edges and meet at a fold line in order to form a three-edged containment section for product 24 within the interior of bag 10. Bag 10 includes three side edges 18, 20 and a bottom edge 22. Access is provided to the interior of bag 10 through a mouth 16.

Product 24 may be a variety of edible food products such as cheese, meat, and various snack-types. However, as will be explained in more detail below, the arrangement is particularly advantageous to containing a product including small grains or powder-like substances. Such products include, among others, granulated sugar, powdered sugar, flour, salt, baking soda, laundry detergent and sand. Other products of this type include snacks which can break apart into powdery-like substances, and crackers which are flavor-covered with cheese, salt or other granular substances.

An important aspect of the present invention concerns the flexible bag's closure arrangement, which extends the length from side edge 18 to side edge 20. The closure arrangement is constructed to inhibit particles, of the type discussed above, from getting into and interfering with the closure action.

In the particular embodiment illustrated in FIGS. 2–8, the closure arrangement includes a zipper illustrated generally at 30. The zipper 30 includes an elongated female profile shown generally at 32 and an elongated male profile shown generally at 34. Female profile 32 is attached to first panel section 12, e.g., by a heat seal. Male profile 34 is similarly attached to second panel section 14. Female and male profiles 32, 34 cooperate by interlocking to allow bag 10 to be opened and reclosed at mouth 16.

Female profile 32 includes first and second parallel legs 36, 38 which provide a channel 40 therebetween. First and second legs 36, 38 are deflectable in order to accommodate male profile 34 into channel 40. First and second legs 36, 38 are deflectable between a mated position, FIGS. 2 and 8, and an unmated position, FIGS. 3 and 4. In the mated position, first and second legs 36, 38 are interlocked with male profile 34, and are deflected outwardly from each other and from channel 40. In the unmated position, first and second legs 36, 38 are not engaging male profile 34.

Figure 3:
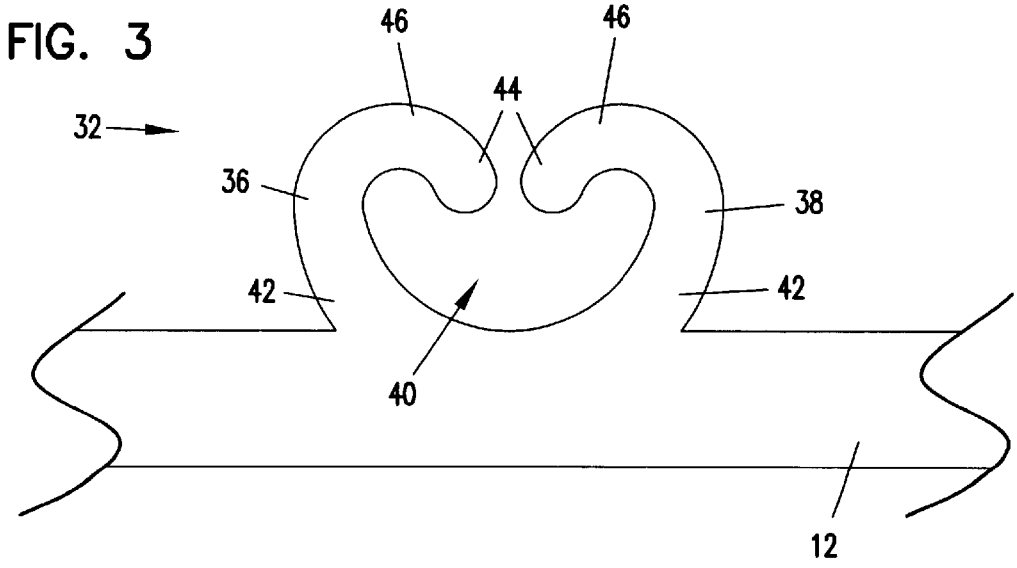
FIG. 3 is a cross-sectional view of a female profile of the closure arrangement, in accordance with the present invention.

In the unmated position, first and second legs 36, 38 are maintained at a distance 41 apart from each other which is sufficient to keep granular products from getting trapped in channel 40. Distance 41 depends upon what type of granular product 24 is being stored within the product containment section. In one implementation illustrated in FIG. 4, the distance 44 between first and second legs 36, 38 is no greater than about 0.007 inch. In other implementations, first and second legs 36, 38 touch one another, thereby having no distance between them. One example of this implementation is illustrated in FIG. 3. The FIG. 3 embodiment is advantageous in keeping out from channel 40 products with very tiny particles or grains. First and second legs 36, 38, when in the unmated position, are flexible to the mated position by the interaction and engagement with male profile 34.

Each of first and second legs 36, 38 includes an attachment end 42 and an engagement end 44. Attachment end 42 is used to attach female profile 32 to first panel section 12 of bag 10. One suitable attachment technique is by heat sealing. Engagement end 44 is at an end opposite to attachment end 42 of first and second legs 36, 38. Engagement end 44 is for engaging male profile 34. Engagement end 44 moves through the largest distance of deflection when first and second legs 36, 38 move from their unmated position to their mated position.

Figure 2:
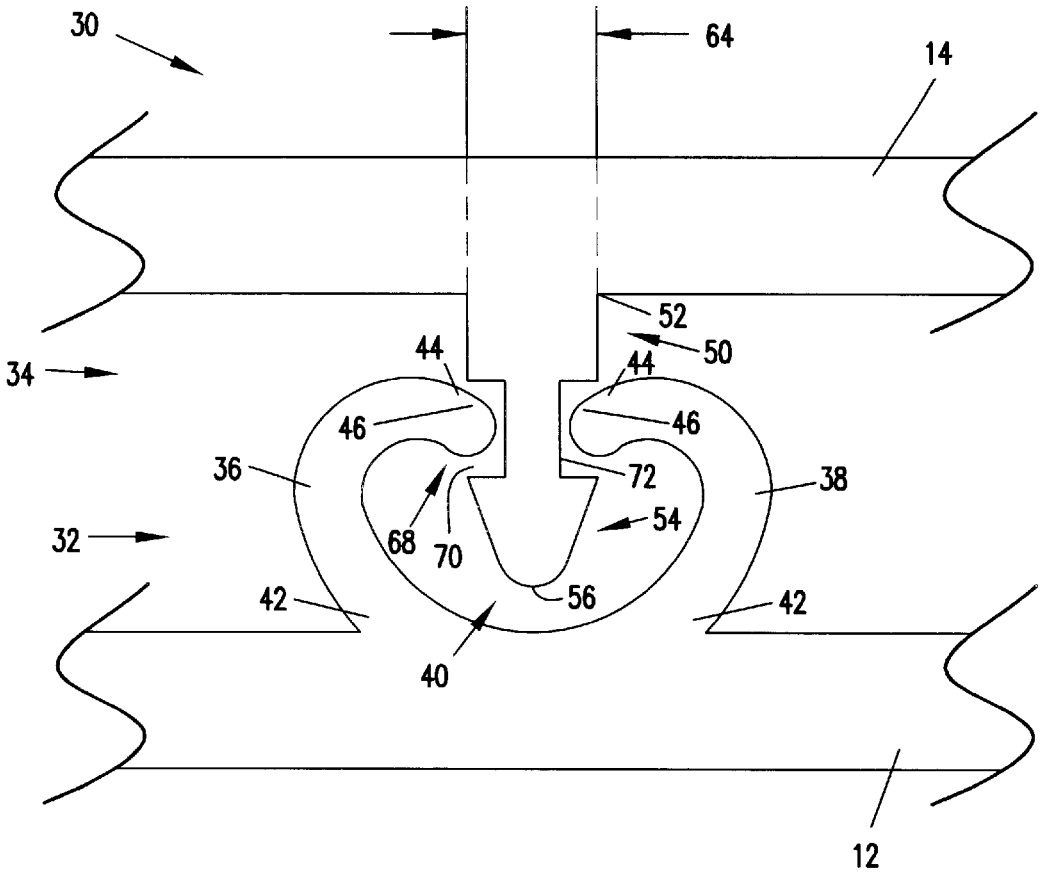
FIG. 2 is a cross-sectional view of the closure arrangement in FIG. 1, in accordance with the present invention.
Figure 4:
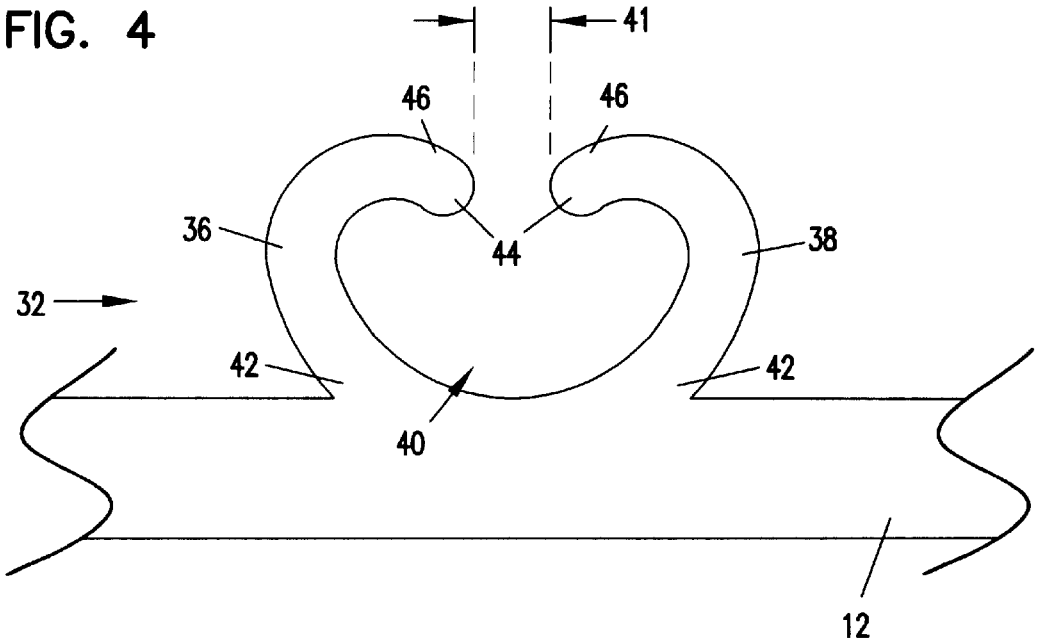
FIG. 4 is a cross-sectional view of an alternate female profile of the closure arrangement, in accordance with the present invention.

In one implementation, engagement end 44 of first and second legs 36, 38 has a rounded surface 46 for contacting male profile 34. Examples of this implementation are illustrated in FIGS. 2, 3, and 4. Rounded surface 46 is contoured, and when interacting with male profile 34, acts as a cam surface to allow male profile 34 to push first and second legs 36, 38 apart and allow male profile 34 to be inserted into channel 40.

Figure 8:
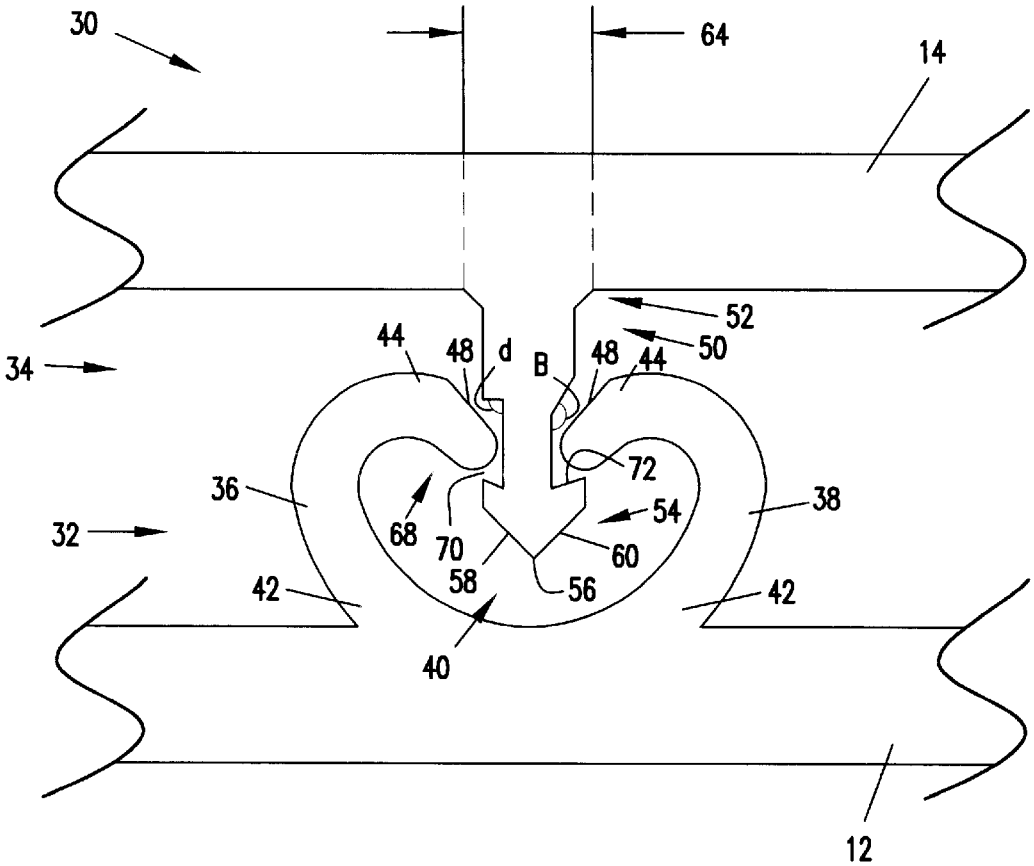
FIG. 8 is a cross-sectional view of an alternate embodiment of a female profile engaging with another alternate embodiment of a male profile of the closure arrangement, in accordance with the present invention.

In another implementation, engagement end 42 of first and second legs 34, 36 include a flat surface 48. Flat surface 48 is generally an angled surface angled toward channel 40. Flat surface 48 helps in aligning male profile 34 to channel 40. Flat surface 48 also aids in interlocking male profile 34 into female profile 32. This is provided using flat surface 48 to act as a camming surface to allow first and second legs 36, 38 to be deflected from the unmated position to the mated position. One example of this implementation is illustrated in FIG. 8.

In one particular implementation, first and second legs 36, 38 are tall and thin. For example, one suitable height is 0.060" inch, and a thickness of 0.012" inch. This leads to advantages. For example, when the legs are relatively tall and thin, it is easier for the user of the zipper to align the male and female profiles and interlock them.

Male profile 34 includes a stem 50 extending from a base 52 to a head 54. Head 54 and base 52 define opposite ends of stem 50.

Certain applications benefit with head 54 being formed to have a curved surface 56. This provides a smooth engagement between the tightly-fitting, interlocking components. Curved surface 56 on head 54 engages the camming surfaces on first and second leg 36, 38. Camming surfaces may be either the rounded surfaces 46 (FIG. 2) or the flat surfaces 48 (FIG. 8) on first and second legs 36, 38. Examples of curved surface 56 on head 54 are illustrated in FIG. 2 and in FIG. 6.

Figure 5:
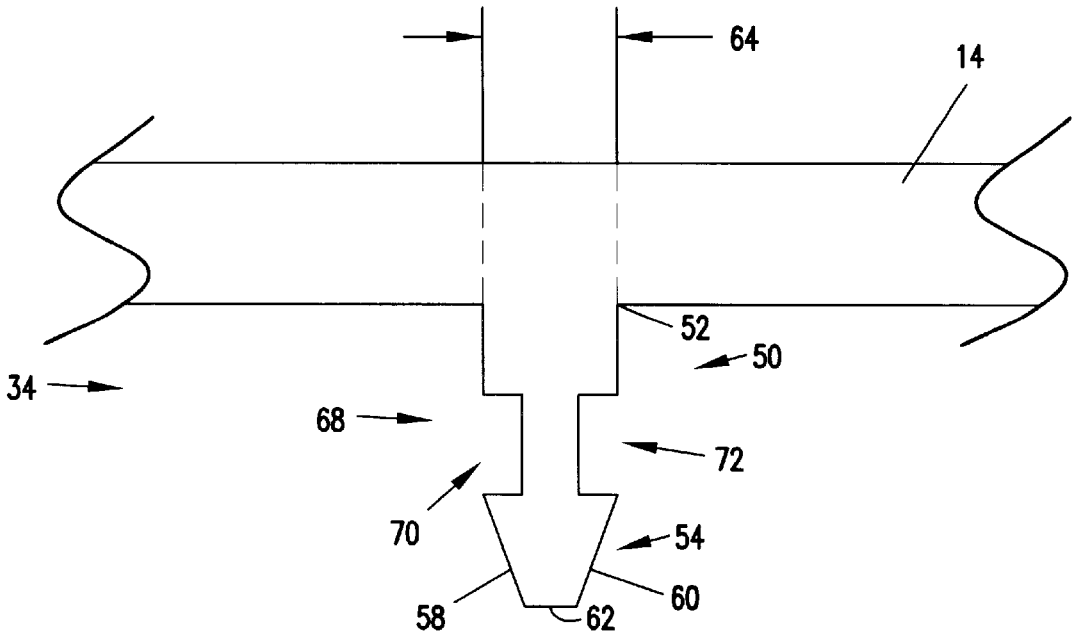
FIG. 5 is a cross-sectional view of an alternate embodiment of a male profile of the closure arrangement, in accordance with the present invention.

In another implementation, head 54 is tapered inwardly toward a central longitudinal axis of stem 50. As illustrated in FIG. 5, head 54 includes a pair of tapered surfaces 58, 60 and a flat end 62. This is also illustrated in FIG. 8. Flat end 62 coupled with tapered surfaces 58, 60 cooperate to result in an easier interlocking zipper. Flat end 62 and tapered surfaces 58, 60 contact camming surfaces 46 or 48 on first and second legs 36, 38 and deflect first and second legs 36, 38 from the unmated position to the mated position.

Across base 52 of first and second legs 36, 38 is a first width 64. In some implementations, it is advantageous that first width 64 be no wider than any other width across stem 50. When first width 64 is the greatest dimension of width across stem 50, it permits first and second legs 36, 38 to be closer to each other. When first and second legs 36, 38 are closer to each other, there is a reduced risk that particles from product 24 will become trapped in channel 40. Where base 52 is wide, an easier deflection of first and second legs 36, 38 is permitted when interlocking female and male profiles 32, 34.

One implementation of first width 64 is illustrated in FIGS. 2, 5, 6, and 7. Another implementation of first width 64 is illustrated in FIG. 8. In the FIG. 8 implementation, base 52 includes an angled surface 66 between the widest portion of base 52 and stem 50. This leads to easier control of interlocking the male and female profiles together.

In one implementation, stem 50 is short. It is advantageous to have stem 50 be at least 0.020 inch shorter than the legs of female profile 32. In another implementation, stem 50 is at a height of about 0.040 inch. By making stem 50 short, there is more control by the user of the zipper in aligning the male and female profiles in order to interlock them together.

Stem 50 includes a region 68 which has a second width which is less than first width 64. One function of region 68 is to provide a surface to allow first and second legs 36, 38 to engage and interlock the male and female profiles together. In one implementation, region 68 includes first and second notches 70, 72 on opposite sides of stem 50. An example of this implementation is illustrated in FIGS. 2, 5, and 8. Engagement ends 44 of first and second legs 36, 38 engage, or interlock, within first and second notches 70, 72. This permits mouth 16 of bag 10 to be closed.

In one implementation, as illustrated in FIG. 8, second notch 72 is deeper than first notch 70. Second notch 72 is the notch which is closest to bottom edge 22, and furthest from mouth 16. By making second notch 72 deeper than first notch 70, a user is able to interlock male and female profiles easier than if the notches were the same depth. Further, the interlock is made stronger in the second notch region due to the increased depth. This results in an increased integrity of the zipper seal.

In certain implementations, e.g., as illustrated in FIG. 8, first notch 70 and stem 50 define an angle I therebetween, and second notch 72 and stem 50 define an angle θ therebetween. In certain applications, this angle I is no more than about 90°, and angle θ is greater than about 90°. When angle I is no greater than about 90°, and when angle θ is greater than about 90°, certain advantages result. For example, the angle I allows the consumer an easier alignment in order to interlock male and female profiles. The angle θ, being on the side nearer bottom edge 22, results in a stronger lock improving the integrity of the zipper seal. Other angles besides those illustrated are also contemplated.

Figure 6:
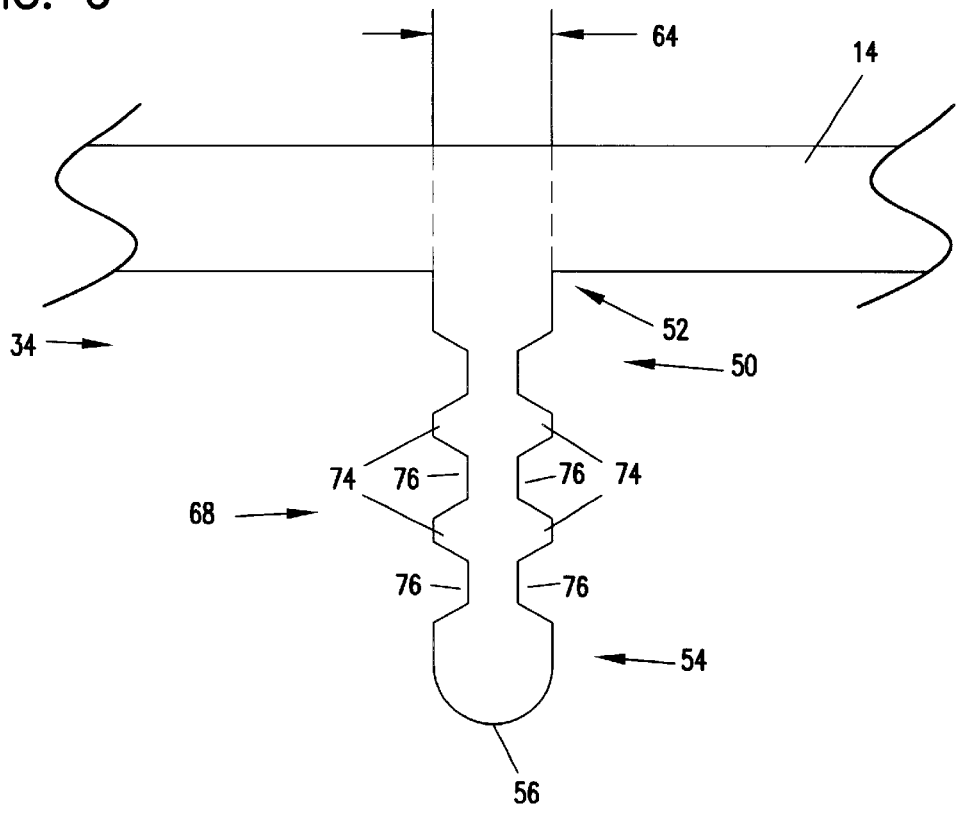
FIG. 6 is a cross-sectional view of another alternate embodiment of a male profile of the closure arrangement, in accordance with the present invention.

In another implementation, region 68 includes a series of bumps 74 and troughs 76 on first and second opposite sides of stem 50. One example of this implementation is illustrated in FIG. 6. Bumps 74 and troughs 76 include surfaces for engagement end 44 of first and second legs 36, 38 which engage and interlock the male and female profiles. A sufficient number of bumps and troughs 74, 76 provide for easy engagement. Although four bumps and troughs are illustrated in FIG. 6, it is contemplated that other numbers may be used.

Figure 7:
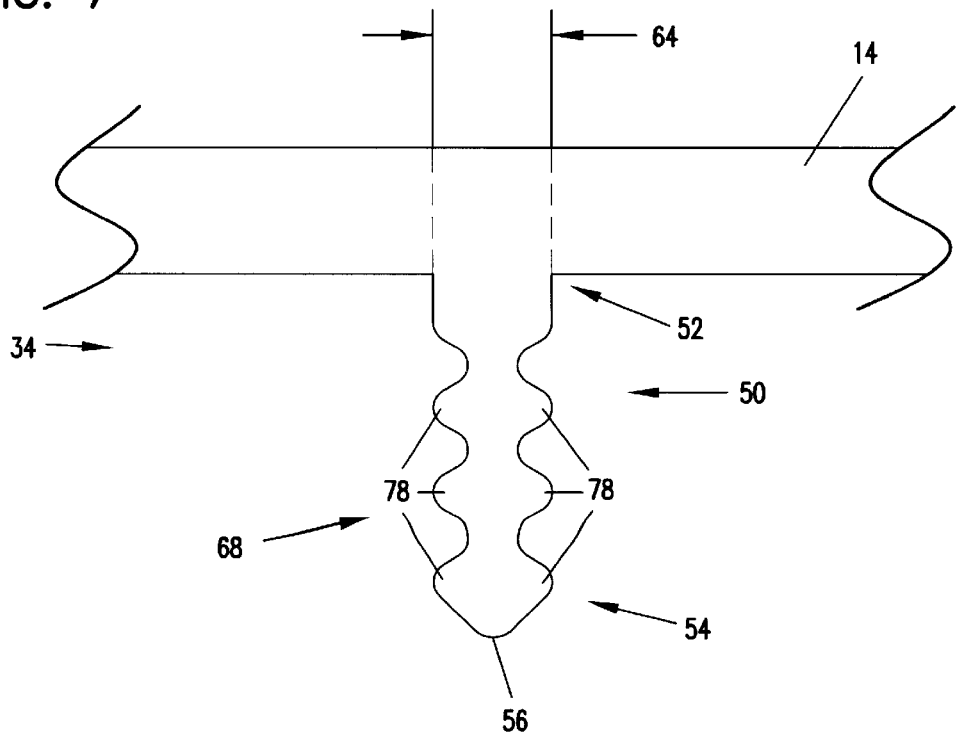
FIG. 7 is a cross-sectional view of another alternate embodiment of a male profile of the closure arrangement, in accordance with the present invention.

Another implementation of region 68 is illustrated in FIG. 7. In this implementation, region 68 includes a series of barbs 78 on first and second opposite sides of stem 50. Barbs 78 provide surfaces for engaging engagement ends 44 of first and second legs 36, 38 in order to interlock the male and female profiles.

Figure 9:
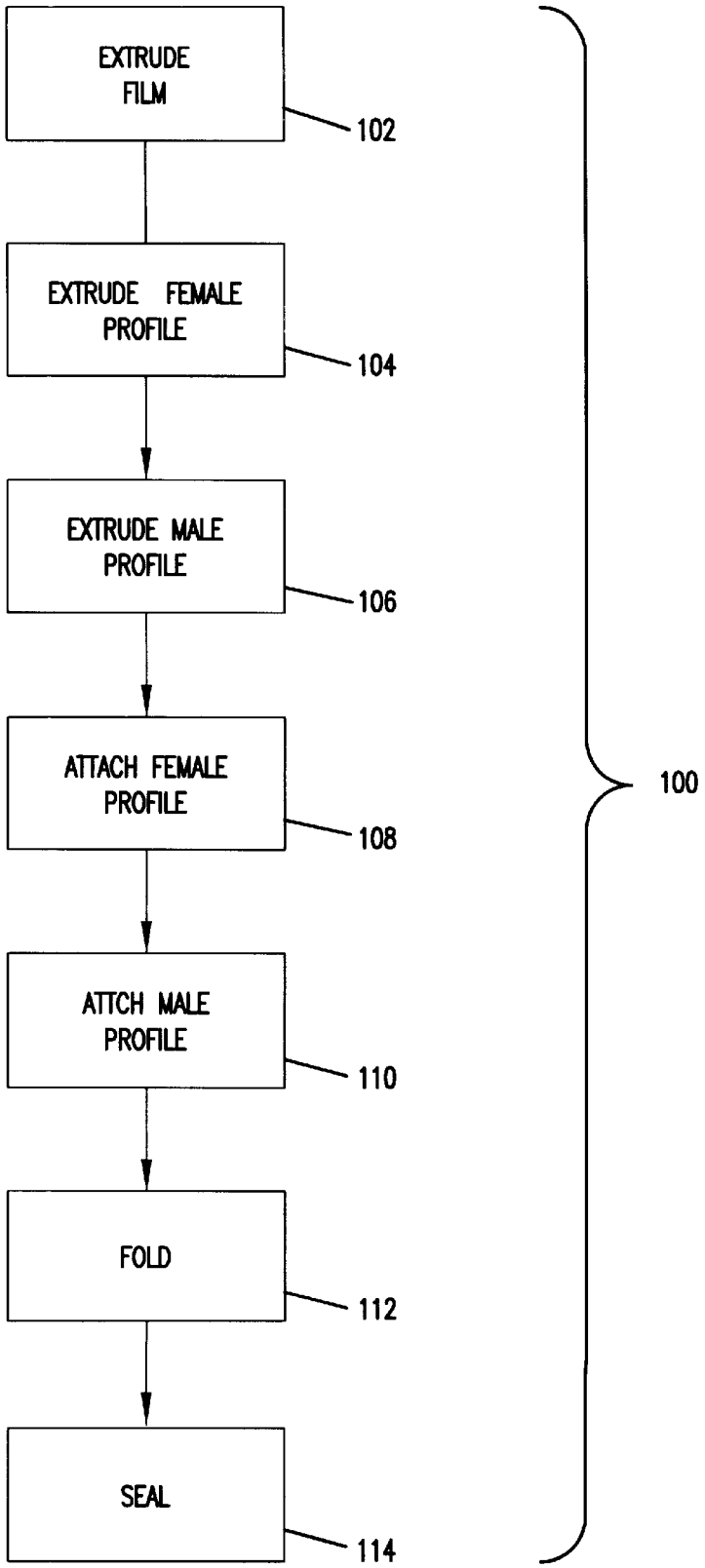
FIG. 9 is a flowchart illustrating a method, in accordance with another aspect of the present invention.

One implementation of a method for making a reclosable bag is illustrated in FIG. 9 at 100. At step 102, a continuous film is provided. This may be accomplished by extruding a polymeric material from a suitable extruder to provide a continuous sheet of polymeric film.

Next, the female and male profiles 104, 108, respectively, are extruded and attached to the film 102. One way of implementing the extrusion steps is by extruding a polyethylene material through a suitable die, and cooling the profiles. The dies have the appropriate shape to provide the desired profile shape. For example, the female die is shaped such that the resulting profile provides the appropriately-sized gap between the first and second legs 36, 38. The gap size is selected based upon the grain size of the products to be stored in the resulting bag. If making the implementation illustrated in FIG. 3, where first and second legs 36, 38 touch each other, the line speed is carefully controlled and the profile is quickly cooled so as to avoid having first and second legs 36, 38 fused together. Similarly, the desired profile shape of the male profile dictates the die shape.

As part of steps 104, 108, the male and female profiles also are attached to the film. One suitable way of accomplishing this task is by using the latent heat of the extruded members, with or without additional heat, to seal the male and female profiles to the film such that when the film is folded, the male and female profiles will align and permit them to be interlocked.

At step 112, the film with the attached male and female profiles is folded, and the male and female profiles are aligned to allow for them to be mated. At step 114, seals along the non-folded edges are provided. One suitable technique for sealing is by heat sealing. This creates an enclosed region suitable for holding product 24.

It will be apparent to those skilled in the art that various modifications and variations can be made to the embodiments illustrated herein without departing from the scope or spirit of the invention. For example, a zipper having a peelable seal that provides a tamper indication can also be used with the embodiments illustrated herein. One example of a peelable seal can be found in U.S. Pat. No. 5,470,156, hereby incorporated by reference. Further, tear strings and notches may also be used with the embodiments illustrated herein. Such modifications and variations do not depart from the true scope and spirit of the invention which is set forth by the following claims.

I claim:

1. A reclosable bag comprising:

(a) first and second opposing panel sections; a female profile and a male profile;

(b) said female profile secured to the first panel section of the bag;

(i) said female profile including first and second opposing legs;

(A) the first and second legs each including an attachment end arranged to attach to the first panel section, and an engagement end arranged to engage the male profile;

(c) said male profile secured to the second panel section of the bag and arranged to operably interlock with said female profile; said male profile including a base, a stem, and a head;

(i) said base being secured to said second panel section; said base having a first width;

(A) said first width being no greater than any other width across said head;

(B) said first width being a greatest dimension of width across said male profile:

(ii) said stem extending from said base with a same width as said first width; said stem further including a region having a second width;

(A) said second width being less than said first width;

(B) the region including first and second notches on opposite sides of the stem; the engagement end of the first leg engaging the first notch, and the engagement end of the second leg engaging the second notch;

(1) the second notch being deeper than the first notch; and (iii) said head extending from said stem, at an end of said male profile opposite of said base;

(A) said head being no wider than said first width.

2. A recloseable bag according to claim 1 wherein:

(a) said head is tapered inwardly.

3. A recloseable bag according to claim 1 wherein:

(a) a height of the male profile is at least 0.010 inch less than a height of the female profile.

4. The bag of claim 1, wherein each of the engagement ends of the first and second legs include a flat surface arranged to contact the male profile.

5. The bag of claim 1, wherein the first notch is angled with respect to the stem no more than about 90 degrees.

6. The bag of claim 5, wherein the second notch is angled with respect to the stem greater than about 90 degrees.

7. The bag of claim 1 wherein:

the first and second panel sections are joined together along three edges to create an enclosed region for holding a granular product.

* * * * *